United States Patent [19]

Atchisson

[11] Patent Number: 4,487,103

[45] Date of Patent: Dec. 11, 1984

[54] DRUM MAGAZINE

[76] Inventor: Maxwell G. Atchisson, 6695 Ridgemoore Dr., Doraville, Ga. 30360

[21] Appl. No.: 391,665

[22] Filed: Jun. 24, 1982

[51] Int. Cl.[3] ..... F41C 25/10; F41D 10/12

[52] U.S. Cl. ..... 89/33.02

[58] Field of Search ..... 89/33 D, 33 R, 33 SF; 42/50, 19

[56] References Cited

U.S. PATENT DOCUMENTS

| | | | |
|---|---|---|---|
| 979,721 | 12/1910 | Sunngard | 89/33 D |
| 1,867,513 | 7/1932 | Lahti | 89/33 D |
| 2,007,774 | 7/1935 | Sedgley | 42/50 |
| 2,131,412 | 9/1938 | Östman | 42/19 X |
| 2,338,984 | 1/1944 | Van Horn | 89/33 D X |
| 4,332,097 | 6/1982 | Taylor | 89/33 D |

OTHER PUBLICATIONS

"The World's Fighting Shotgun" by Thomas F. Swearengen, Copyright 1978, pp. 385–398.

"Gun World", Aug. 1971, pp. 40–42.

"Jane's Infantry Weapons", Copyright 1974, p. 337.

*Primary Examiner*—Richard E. Schafer

*Assistant Examiner*—David K. Cornwell

*Attorney, Agent, or Firm*—Jones & Askew

[57] ABSTRACT

A drum magazine particularly intended for feeding shotgun shells to a firearm such as an autoloading assault shotgun. The drum magazine includes a cartridge-carrying rotor having a pair of sprockets, and powered by a torsion spring disposed on a central post within the drum. A last-round cartridge follower, removably carried by the rotor, can move either to a radially-extended position to feed the last round from the drum, or to a position of reduced effective radius to accommodate the first round in the fully-loaded drum. The drum magazine is adaptable to shells of different lengths.

18 Claims, 15 Drawing Figures

DRUM MAGAZINE

FIELD OF INVENTION

This invention relates in general to drum magazines for firearms, and relates in particular to a drum magazine for feeding shells to an assault shotgun or the like.

BACKGROUND OF THE INVENTION

The need to provide an adequate ammunition capacity is always a consideration with autoloading firearms. This consideration is particularly important with firearms intended for use in military or law-enforcement applications, especially where the firearm is capable of full-automatic fire. Cartridge magazines of limited capacity may have to be changed or reloaded too frequently for effectiveness or safety in combat applications, and may also further burden the shooter who must carry additional magazines necessary for the desired number of rounds.

Detachable cartridge magazines generally take the form either of a box magazine, in which the rounds are held and fed in a straight or staggered line; or a drum magazine in which the rounds are held and fed on a generally circular or spiral path. Although each kind of magazine has certain advantages and disadvantages, a drum magazine generally can be designed to hold and effectively feed more rounds than a box magazine, other factors being equal.

Notwithstanding the foregoing, a box magazine can provide desired round-holding capacity for many applications, particularly for smaller-caliber firearms where box magazines holding twenty or even thirty rounds can be built without undue length or feeding problems during automatic firing. With larger-caliber firearms, the physical size and weight of cartridges make box magazines impractical for more than about ten rounds. This problem is especially acute in the case of assault shotguns such as disclosed in copending patent application Ser. No. 336,328 filed Dec. 31, 1981, where the assault shotgun is intended for military or other combat applications and may be selectively capable of full-automatic firing.

Although drum magazines are known in the art, existing drum magazine designs generally have various disadvantages which may become more pronounced if these designs are adapted for loading and feeding shotgun shells. For example, prior-art drum magazines tend to be relatively heavy even when empty, and become correspondingly heavier when fully loaded with relatively heavy ammunition such as shotgun shells. Moreover, some drum magazines are difficult to reload without removing the drum cover or lid, an operation which is not recommended for loading in the field. Moreover, drum magazines of the prior art sometimes are less dependable in feeding rounds to a firearm under full-automatic fire, especially where the relative size and mass of shotgun shells is considered. This problem is compounded by the fact that the overall length of shotgun shells of a given size, e.g., twelve gauge, varies depending on factors such as the load of the shell. An effective drum magazine for a particular firearm should be capable of loading and feeding the various kinds of shells for which the firearm is chambered.

SUMMARY OF INVENTION

Stated in general terms, the drum magazine of the present invention comprises a unitary drum body preferably of molded unitary fabrication. A center post is axially disposed in the drum body, and a rotor is supported by the center post for rotation within the body. A number of shell-receiving recesses are formed at the periphery of the rotor. An axial spring surrounds the center post, and powers the rotor to advance the shells in sequence to a feeding element for diverting the shells from the rotor path to the shell-feeding lips on the drum body. The rotor carries a follower which feeds the last remaining shell, yet which permits the fully-loaded rotor to accommodate inward movement of the first round during cocking of the firearm.

Stated in somewhat greater detail, the body of the drum magazine preferably comprises a side portion, front cover, and center post formed as a unitary article. An axle member is secured to the outer end of the center post. The rotor includes a pair of spaced-apart sprockets with shell-receiving recesses formed about their peripheries, and the rear sprocket fits over the axle as the rotor is disposed on the center post. The spacing between sprockets of the rotor allows the axial spring powering the rotor to be entirely contained between the sprockets, and one arm of the axial spring selectably engages various locations around the rotor to adjust the amount of torque applied to the rotor. The last-round follower is carried in cut-out portions on the sprockets of the rotor, allowing the follower to extend radially outwardly during last-round feeding yet to lay over and allow drum diameter reduction when the rotor is fully-loaded.

Accordingly, it is an object of the present invention to provide an improved drum magazine.

It is another object of the present invention to provide an improved drum magazine particularly for feeding shotgun shells.

It is yet another object of the present invention to provide a drum magazine for use with an assault shotgun.

It is a further object of the present invention to provide a drum magazine particularly intended for feeding shotgun shells, and being of relatively lightweight and simplified construction.

Other objects and advantages of the present invention will become more readily apparent from the following.

DESCRIPTION OF PREFERRED EMBODIMENT

Figure 1:
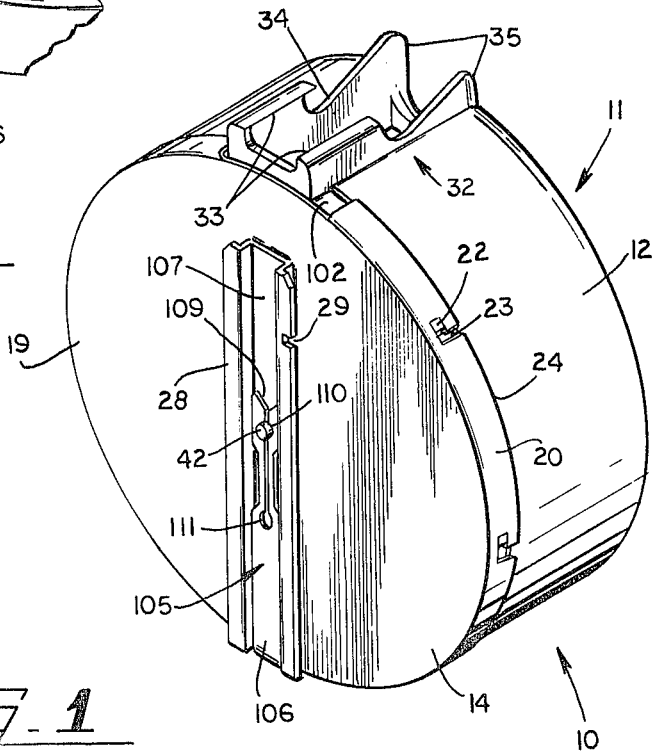
FIG. 1 is a pictorial view showing an assembled drum magazine according to a preferred embodiment of the present invention.

Turning first to FIG. 1, there is shown generally at 10 a drum magazine according to a preferred embodiment of the invention. Although this specific embodiment is disclosed and described as a magazine for shotgun shells, it should become apparent to those skilled in the art that many of the structural and functional features described herein are adaptable to drum magazines for other rounds such as rifle cartridges or the like.

Figure 2:
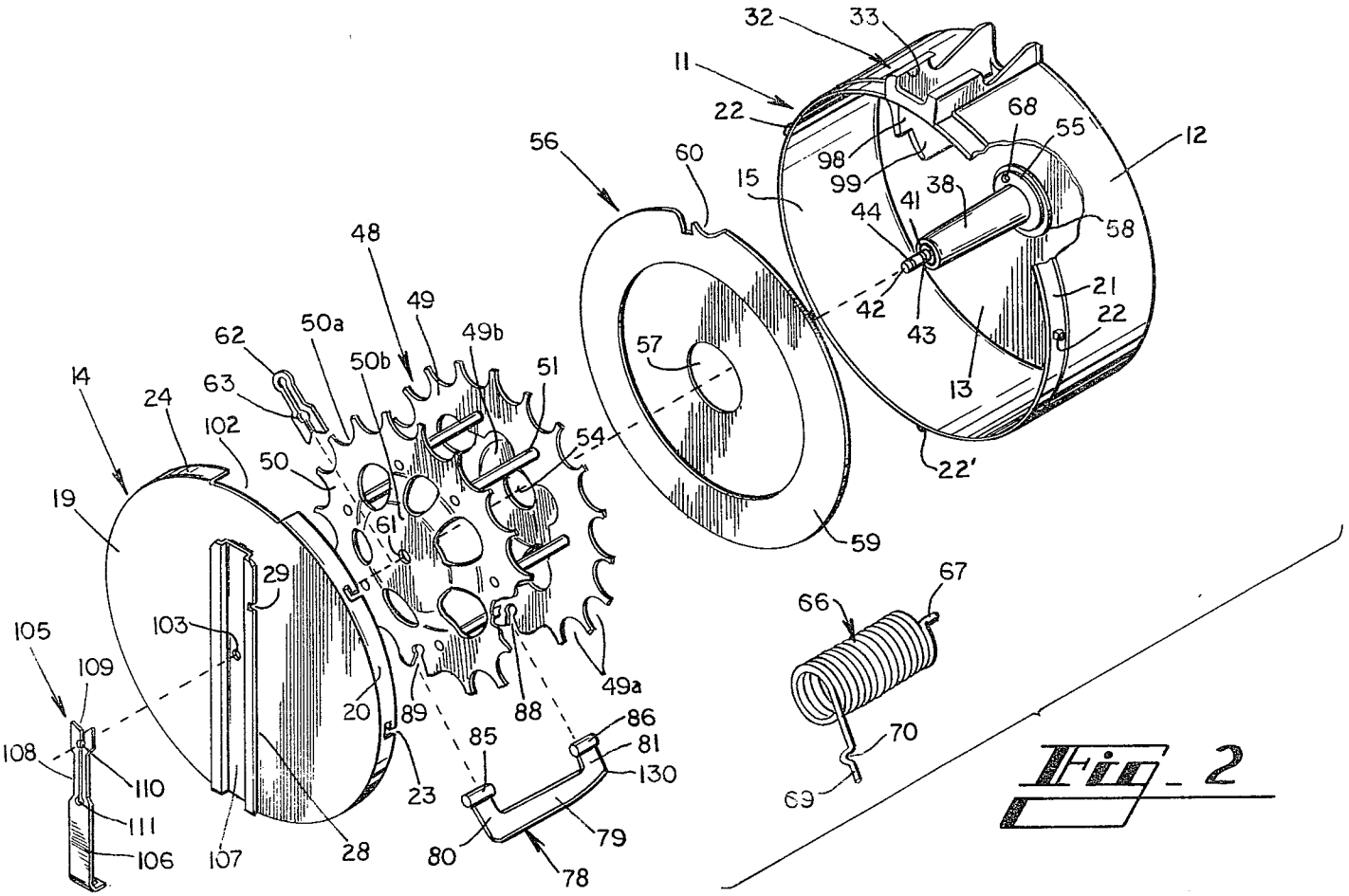
FIG. 2 is an exploded view of the drum magazine shown in FIG. 1.
Figure 4:
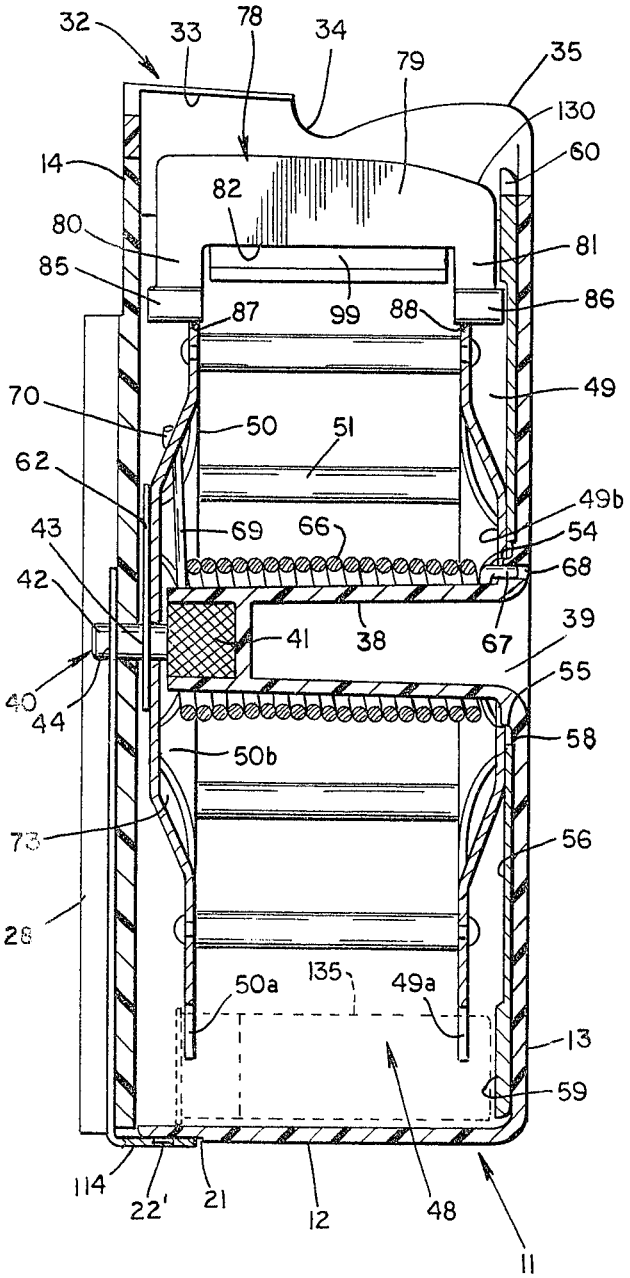
FIG. 4 is a section view taken along line 4—4 of FIG. 3, with the magazine lid shown attached.

The drum magazine 10 has a body 11 which, as best seen in FIGS. 2 and 4, comprises a cylindrical drum housing 12 and the front wall 13. The body 11 is preferably of unitary one-piece construction, and may be fabricated by molding from a sutable plastic material having the requisite structural strength and impact resistance.

A lid 14 fits over and encloses the open back end 15 of the drum magazine body 11. The lid 14, which may be made of the same material as the drum body 11, has a flat wall 19 forming the back end of the magazine 10 and a circumferential flange 20 extending forwardly a short distance from the extremity of the wall. The flange 20 telescopically fits over the cylindrical housing 12 of the assembled magazine, and as seen in FIGS. 2 and 4 the outer diameter of the cylindrical housing is reduced at 21 to accommodate the lid flange.

The lid 14 is removably secured to the body 11, and is held in place by a number of lugs 22 spaced around the reduced-diameter portion 21 of the cylindrical housing and extending radially outwardly therefrom. These lugs 22 engage corresponding L-shaped slots 23 formed in the flange 20 of the lid and open to the forward edge 24 of the flange. The lugs 22 and interconnecting slots 23 thus provide multipoint attachment of the lid 14 to the drum body 11 at several points spaced around the back end 15 of the drum body. Another lug 22', preferably of rectangular cross-section, extends radially outwardly from the bottom of the drum body 11 and cooperates with the lid lock 105 to lock the lid 14 to the drum body as described below in greater detail.

Disposed on the outside of the lid wall 19 is the magazine lug 28, which removably secures the magazine 10 to the particular firearm for which the magazine is intended. The specific disclosed magazine lug 28, designed to fit the magazine bracket of the particular firearm disclosed in the copending patent application identified above, may be molded with the lid 14 so as to form an integral part of the lid. A latching notch 29 is formed into one side of the magazine lug 28, for engagement with a complementary magazine latch on the firearm.

Disposed at the top of the magazine housing 12 are the cartridge feed lips 32, and it will be understood that these feed lips fit within the lower receiver of the particular firearm. The feed lips 32 are spaced apart to receive a shell for which the drum magazine is designed, and the back portions 33 of the feed lips are narrowed to define concave undersides which engage and retain the rims of these shells. The sides of the feed lips 32 are scalloped as shown at 34, intermediate the back portions 33 and the front corners 35 (FIGS. 1 and 4), to facilitate loading shells into the drum magazine through the feed lips.

Turning to FIGS. 2 and 4, it is seen that a post 38 axially extends back from the front wall 13 to terminate within the body 11 a short distance in front of the lid 14. This post 38 is an integral part of the molded unitary body 11 in the disclosed embodiment, and the post thus has a hollow interior communicating with the outside of the magazine front wall 13 as shown at 39 in FIG. 4.

Figure 8:
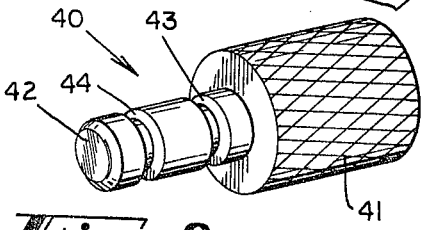
FIG. 8 is an enlarged pictorial view of the sprocket axle in the disclosed embodiment.

A sprocket axle 40 is affixed to the back end of the post 38. This axle 40, shown in detail in FIG. 8, preferably is made of steel or another suitable metal and includes a body portion 41 retained within a receptacle at the back end of the post 38. The post 38 may be molded around the body portion 41 of the axle so as to permanently secure the axle to the post, and the exterior of the body portion may be knurled as shown in FIG. 8 for improved retention within the molded post. Extending back from the body portion 41 is the axle shaft 42, of smaller diameter than the body portion. The annular sprocket retainer groove 43 is formed in the axle shaft 42 a distance behind the axle body 41, and an annular drum retainer groove 44 is formed in the axle shaft a distance behind the sprocket retainer groove. The functions of these two grooves 43 and 44 are described below.

Figure 3:
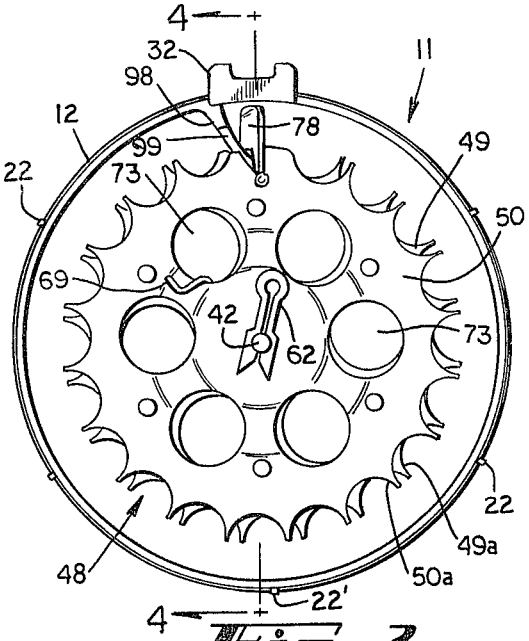
FIG. 3 is an elevation view of the magazine shown in FIG. 1, with the magazine lid removed.

A shell-supporting rotor 48 is disposed within the drum magazine 10 for rotation around the post 38, as best seen in FIGS. 2 and 4, although it will be seen that the rotor does not actually turn on the post. The rotor 48 includes a front sprocket 49 and a back sprocket 50, the two sprockets being held together in spaced-apart relation by a number of spacers 51 secured to the front and the back sprockets by riveting or the like. A number of semicircular shell-receiving recesses **49*a*, 50*a* are formed in the peripheries of the respective sprockets, and as seen in FIG. 3** the sprockets are angularly offset by a slight amount, for example, 2°, so that the corresponding shell-receiving recesses on each sprocket are slightly misaligned. The purpose of this intentional misalignment is set forth below.

Each sprocket 49 and 50 preferably is formed by stamping from sheet metal, and each sprocket has a respective central region **49*b*, 50*b* dished outwardly with respect to the peripheral regions on which the cartridge-receiving recesses are formed. The axial spacing between the central regions 49*b* and 50*b* of the sprockets permits the rotor 48 to fit over the post 38 of the drum body without contacting that post, as best seen in FIG. 4. A central opening 54 in the central region 49*b* of the front sprocket 49 fits over the sprocket bearing diameter 55 formed surrounding the base of the post 38. The relative dimensions of the sprocket bearing diameter 55 and the opening 54 in the front sprocket allow the front sprocket to turn freely on the sprocket bearing diameter. The sprocket bearing diameter 55 preferably is axially spaced a short distance behind the inside surface of the magazine body front wall 13, thereby providing sufficient room to accommodate the optional removable drum spacer 56. The drum spacer has a central opening 57 which snugly fits around the diameter 58 formed at the base of the post 38, in front of the sprocket bearing diameter 55. The drum spacer 56 and its purpose are further described below, and it will be realized that the drum spacer in many cases can be omitted from the drum magazine assembly shown in FIGS. 2 and 4** without affecting the assembly or operation of the magazine or its remaining components.

The central region 50*b* of the back sprocket 50 has a central opening 61 substantially smaller than the coaxial opening 54 in the front sprocket. The axle shaft 42 of the sprocket axle 40 fits through the central opening 61 in the back sprocket 50, supporting the back sprocket for rotation relative to the axle shaft. With the rotor 48 positioned around the post 38 so that the opening 54 in the front sprocket engages the bearing diameter 55 and the axle shaft 42 extends through the opening 61 in the back sprocket, the sprocket groove 43 on the axle shaft is located immediately behind the dished central region 50*b* of the back sprocket. The sprocket retainer 62, bifurcated to form two cantilever fingers open at one end to engage the sprocket groove 43 on the axle shaft and having an enlarged interior region 63 to snap-fit engage the sprocket retainer groove, snaps on the sprocket groove to retain the rotor 48 in place within the body 11 of the drum magazine. The rotor 48 thus is retained and supported within the body for free rotation about the post 38, although the rotor is maintained out of contact with the post.

Rotational torque is applied to the rotor 48 by the torsion spring 66, which loosely surrounds the post 38 within the body 11 of the drum magazine. The front end 67 of the torsion spring projects forwardly in front of the spring, and fits within a hole 68 formed in the inside of the magazine front wall 13, within the diameter 55 provided for supporting the optional drum spacer 56. The front end 67 of the torsion spring 66 thus is secured relative to the body 11 of the drum magazine. The back end 69 of the torsion spring 66 extends outwardly at a tangent to the coiled torsion spring as best seen in FIG. 2. The back end 69 is bent to define the hook 70 for engaging the rotor 48.

Figure 6:
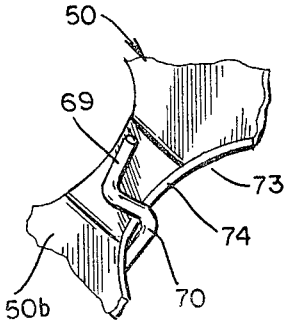
FIG. 6 is an enlarged fragmentary view detailing engagement of the torsion spring with a sprocket of the rotor in the disclosed embodiment.

A number of lightening holes 73 are formed in each sprocket 49 and 50. These holes 73 are formed in the sprocket regions radially bridging the outwardly-dished central regions 49*b*, 50*b* and the recesses 49*a*, 50*a*, and the holes thus are radially spaced outwardly from the rotational axis of the rotor 48. Referring now to FIG. 4, the torsion spring 66 is seen to be contained entirely within the rotor 48, between the spaced-apart central regions 49*b* and 50*b*. The front end 67 of the torsion spring extends forwardly through the enlarged hole 54 in the front sprocket 49, and the back end 69 of the torsion spring extends outwardly within the dished central region 50*b*of the back sprocket 50 to protrude through one of the holes 73 in the back sprocket. The hook 70 formed in the back end 69 of the torsion spring engages the back sprocket 50 at the edge 74 of a lightening hole 73, as best seen in FIGS. 3 and 6. The back end 69 of the torsion spring 66 engaging the back sprocket thus provides a torque arm imparting spring torque to the rotor 48. It will be understood that the amount of torque preload on the rotor can be adjusted by selecting the particular hole 73 for engagement by the back end 69 of the torsion spring.

Figure 12:
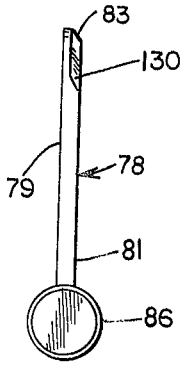
FIG. 12 is an end elevation view of the follower, as seen from the left in FIG. 10.
Figure 11:
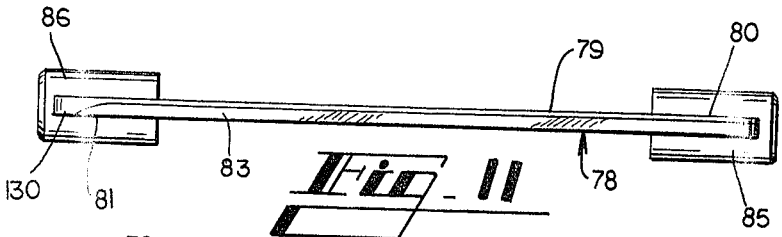
FIG. 11 is a top view of the follower shown in FIG. 10.
Figure 10:
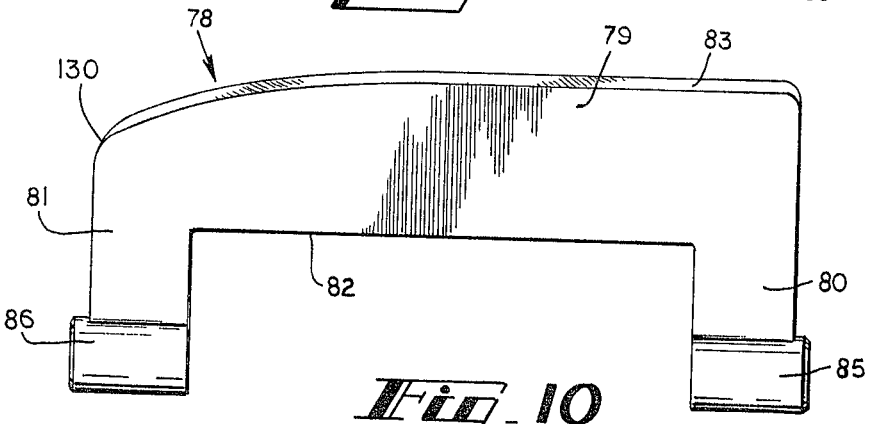
FIG. 10 is a plan view of the follower in the disclosed embodiment.

The rotor 48 is fitted with a follower 78 which feeds the last round from the drum, and which also functions as a rotation stop for the rotor. The follower 78, best seen in FIGS. 10–12, is generally C-shaped in configuration and includes a portion 79 bridging the space between the front and back sprockets of the rotor 48. The upper edge of the bridging portion 79 is beveled to provide the surface 83 for engaging and feeding the last round remaining in the rotor, as explained below. Arms 80 and 81 extend outwardly at right angles to the ends of the bridging portion 79, so that a cutout region 82 is defined between the two arms of the follower 78.

Figure 9:
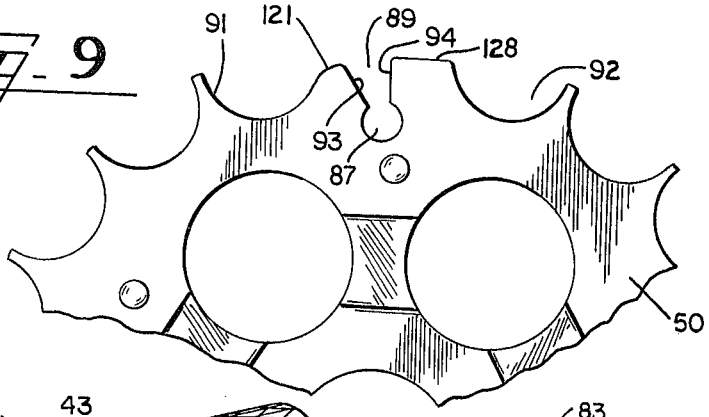
FIG. 9 is an enlarged elevation view showing details of a sprocket used in the disclosed embodiment.

The enlarged pivot radiuses 85 and 86 are formed at the outer ends of the respective arms 80 and 81. The diameters of these pivot radiuses are slightly less than the diameters of the matching follower retaining slots 87 (FIGS. 4 and 9) and 88, respectively formed in the back sprocket 50 and the front sprocket 49. Each retaining slot 87 and 88 is contiguous with the bottom of a respective flip-flop cutout 89 and 90 (FIG. 2) at the periphery of the back and front sprockets, between the first round-receiving recess 91 and the last such recess 92. Each flip-flop cutout is defined by a pair of surfaces 93 and 94 diverging outwardly from the follower retaining slots 87 and 88, as shown in detail in FIGS. 7A–7D and 9, so that the flip-flop cutouts are generally pie-shaped to define an arc of allowable movement for the follower 78.

The assembly and operation of the drum magazine is now described, together with additional details of the present embodiment. Initial assembly of the magazine is accomplished by positioning the torsion spring 66 within the rotor 48 and placing the rotor (with follower 78 temporarily removed) over the post 38 of the drum body 11. The front end 67 of the torsion spring engages the mating hole 68 in the front wall of the drum. The back end 69 of the torsion spring 66 is positioned through a selected lightening hole 73 in the back sprocket 50. The sprocket retainer 62 now is attached to the sprocket retainer groove 43 of the axle shaft 42, thereby securing the rotor within the drum.

The rotor 48 is manually turned clockwise (as viewed in FIG. 3) about one-half revolution to prewind the torsion spring. The amount of preload torque thus applied to the rotor is determined by the extent of rotation and by the angular position of the hole through which the back end of the torsion spring extends. When the preload rotation position is reached, the rotor is manually held while the follower 78 is inserted in the rotor by sliding the pivot radius 86 first through the retaining slot 87 in the back sprocket 50, and then to its final resting place in the retaining slot 88 of the front sprocket 50. The pivot radius 85 of the follower 78 at this time is in its corresponding retaining socket 87 in the back sprocket. When the rotor 48 is released, the rotor rotates counter-clockwise under spring torque until the follower 78 reaches the round-feeding ramp 98 extending inwardly within the cyindrical drum housing 12, beneath the feed lips 32 at the top of the drum. Movement of rotor 48 to the position shown in FIG. 3 places the follower 78 into engagement with the feed ramp 98, preventing further rotor movement under the influence of the torsion spring. The follower 78, in combination with the feed ramp 98, thus functions as a rotation stop for the rotor.

The feed ramp 98 has a tongue portion 99 which extends inwardly into the space between the front and back sprockets of the rotor, as best seen in FIG. 4, and this torque fits beneath the cutout region 82 of the follower 78. The counter-clockwise torque applied to the rotor causes the ramp 98 to pivot the follower 78 to the position shown in FIGS. 3 and 7A, where the follower engages the stop surfaces 94 at the right side of the cutouts 89 and 90. At the other extreme of rotation, illustrated in FIG. 7D, the follower 78 moves into contact with the back of the feed ramp 98 and is flipped to contact the left stop surfaces 93 of the cutouts 89 and 90.

With the rotor and related elements thus installed in the drum magazine, the lid 14 may now be attached to the drum body 11. The lid is fitted over the open end 15 of the drum body with each lug 22 engaging a corresponding L-shaped slot 23 on the flange 20 of the lid, and with the cut-away portion 102 (FIGS. 1 and 2) of the lid flange accommodating the back of the feed lips 33 on the drum body. Once seated on the drum body, the lid 14 is rotated to engage the lugs 22 with the slots 23, thus retaining the lid on the durm body. The outer end of the axle shaft 42, including the drum retaining groove 44, now protrudes outwardly through the hole 103 in the lid, located within the channel 107 of the magazine lug 28.

Figure 5:
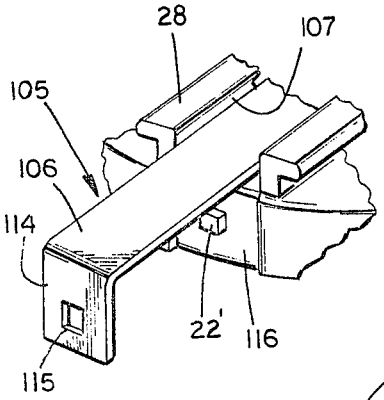
FIG. 5 is an enlarged fragmentary view showing details of the lid lock for the disclosed embodiment.

The lid 14 is now locked onto the drum body 11 by the lid lock 105, FIGS. 1, 2, and 5. The lid lock 105 has a flat elongated body 106 which lies flat within the channel 107 between the flanges of the magazine lug 28 on the back of the lid 14. One end of the lock body 106 is bifurcated to form the two cantilever fingers 108 which engage the drum retaining groove 44 on the axle shaft 42 extending through the hole 103 in the lid 14. The outer ends of the fingers 108 are beveled at 109 to assist in engaging the axle shaft 42, and confronting radii 110 are formed on the fingers inwardly from the beveled outer end to provide a snap-fit engagement with the drum retaining groove 44 of the axle shaft. The slot defined between the bifurcated fingers 108 extends inwardly from the radii 110 to terminate at the opening 111 through the body 106, thereby providing an extended length for the cantilever fingers 108.

The other end 114 (FIG. 5) of the lid lock 105 is bent at a right angle to the body 106, and a rectangular opening 115 is formed through the end 114. This opening 115 mates with the rectangular locking lug 22' on the underside of the drum body 11. The lid lock 105 is dimensioned so that the rectangular opening 115 engages the rectangular locking lug 22' when the body 106 is the lid lock is moved within the channel 107 to engage the axle shaft 42 with the radii 110 of the fingers 108. The flange 20 of the cover 14 is cut away at 116 to accommodate the locking lug 22' and the end 114 of the lid lock, in the foregoing locked configuration. The lid lock 105 thus locks the lid 14 on the axle shaft 42, and by engaging the locking lug 22' within the cutout 116 the lid lock prevents the lid from rotating to disengage the L-shaped slots 23 from the other lugs 22. The assembled and closed drum magazine now is ready for loading.

Figure 7A:
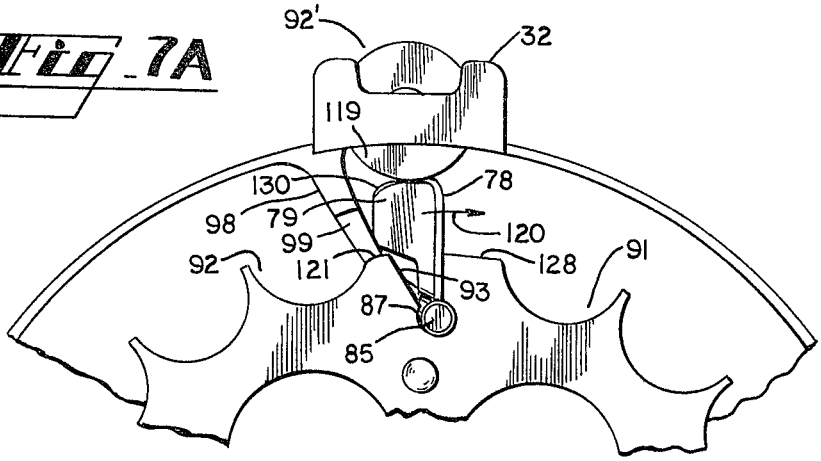
FIGS. 7A–7D are enlarged fragmentary elevation views illustrating several aspects of loading and feeding cartridges in the disclosed embodiment.

The shell loading sequence of the drum magazine is best understood with reference to FIGS. 7A–7D, with FIG. 7A showing the first-loaded round 92' being loaded into the magazine. Inasmuch as round 92' will be the last round fed from the magazine during firing, and this round is carried in the designated last-round recess 92 of the rotor, the round 92' is referred to as the "last round" carried by the magazine.

Because the back sprocket 50 of the rotor is angularly offset a few degrees clockwise (as viewed in FIG. 3) relative to the front sprocket 49 as previously described, the follower 78 likewise is carried by the rotor in a skewed attitude as shown in FIG. 7A. This skewed attitude of the follower places the follower bridging portion 79 at a skewed position beneath the open feed lips 32 on the magazine body, and this skewed position of the follower combined with the beveled edge 83 at the top of the bridging portion presents a cam surface to the round 92' first loaded into the magazine. Thus, as the rim 119 of the first-loaded round 92' is fed into the feed lips 32 at the scalloped region 34 (FIG. 4), the rim contacts the beveled edge 83 at the back of the follower bridging portion 79, and this contact cams the follower 78 and rotor 48 clockwise as indicated by the arrow 120 in FIG. 7A.

Once the rim 119 of the shell 92' is pushed below the overhanging back portion 33 of the feed lips 32, the shell is moved back to be entirely received and retained between the feed lips. The first-loaded round 92' now occupies the position shown in FIG. 7A, where the rotor is somewhat clockwise of the initial position in FIG. 3 and with the first-loaded round resting slightly left of center on the radius 121 at the right side of the last-round recess 92, as better shown in FIG. 7B. The radius 121 is located in front of the rim 119 as shown in FIG. 7B, because of the spacing between front and back sprockets at the circumference of the rotor.

Figure 7B:
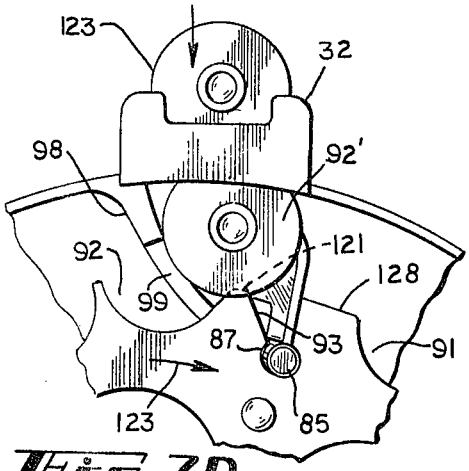
Figure 7C:
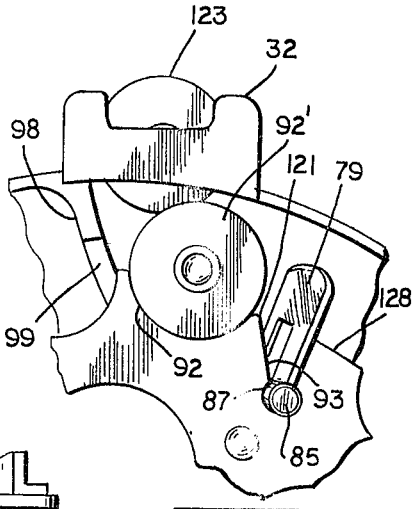

The next round 123, FIG. 7B, is loaded into the magazine in a manner similar to the first-loaded round 92'. The round 123 is inserted rim-first through the scalloped portion 34 of the feed lips 32, pressing downwardly on the first-loaded round 92' and forcing that round against the cam surface provided by the off-center radius 121 of the back sprocket. This force applied to the back sprocket through the radius 121 rotates the rotor further in the clockwise direction shown by the arrow 123, moving the last-round recess 92 into position to receive the round 92' as shown in FIG. 7C. The second-loaded round 123 may now be moved beneath the back portion 33 of the feed lips 32, to retain that round within the feed lips.

Subsequent rounds may now be loaded into the drum magazine in the foregoing manner. Because the round in the feed lips 32 is held slightly to the left of the round immediately below in the rotor, the rotor is indexed clockwise as each succeeding round is loaded through the feed lips. The clockwise rotation of the rotor moves successive recesses **49*a* into position beneath the round-feeding ramp 98'** to receive successive rounds loaded through the feed lips.

Figure 7D:
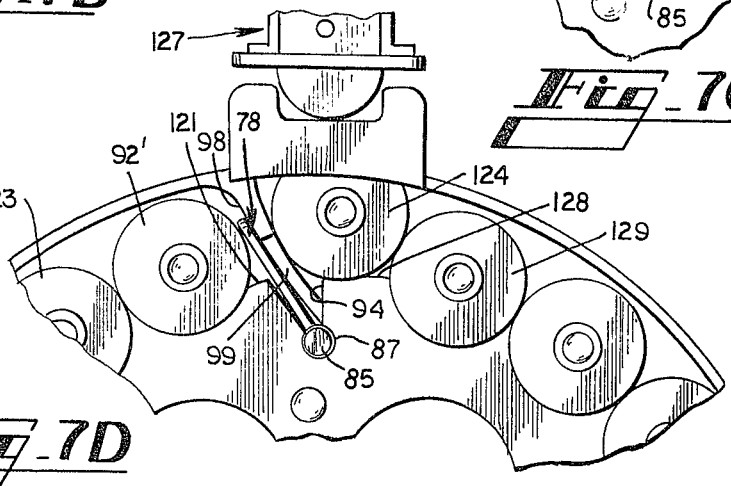

Successive rounds are loaded until the last-loaded round 124, FIG. 7D, is inserted. The round 124 normally would be held within the feed lips 32, but is shown in FIG. 7D depressed below the feed lips for a reason described below. In this fully-loaded position of the rotor 48, the follower 78 has contacted the back of the feed ramp 98 and is flipped to its left-most position contacting the surface 93 of the flip-flop cutout 89 in the rotor sprockets.

The fully-loaded drum magazine may now be attached to a firearm by engaging the magazine lug 28 with complementary structure on the firearm. As the feed lips 32 of the drum are moved into the lower receiver of the firearm, the first round 124 in the drum contacts the underside of the bolt 127 (FIG. 7C) of the firearm, assuming the bolt is closed at the time. This engagement with the bolt 127 moves the first round 124 downwardly below the feed lips 32, and the radius of the rotor sprockets is reduced at 128 between the follower 78 and the first round-receiving recess 91 to accommodate depression of the first round in the fully-loaded drum. It will be understood that the rotor 48 is rotated slightly clockwise by this depression of the first round 124, thereby assuming the position shown in FIG. 7D.

It should now be apparent that as the firearm is cocked, the bolt 127 is moved rearwardly (up from the paper, as viewed in FIG. 7C) to be behind the first round 124 in the drum. The torsion spring 66 then moves the rotor 48 counter-clockwise, moving the first round 24 back up the curved feed ramp 98 and into the feed lips 32. As the bolt 127 then moves forward, the bolt strips the round 124 from the feed lips and chambers the round in the conventional manner. As the round 124 is stripped from the magazine, the rotor 48 under power of the torsion spring again rotates counter-clockwise to place the next round 129 on the feed ramp 98, immediately beneath the now-closed bolt 127. When the firearm is fired, the normal action of the bolt 127 will feed the next round 124 from the magazine, and so on until the magazine is emptied.

When only the last two rounds remain to be fired, the rotor and follower 78 again assume the position shown in FIG. 7B where the follower is flipped to the right within the sprocket cutouts 89, 90 and the tongue 99 of the feed ramp 88 has guided the round 92' out of its recess 92 in the rotor. When the next-to-last round 123 is fed from the feed lips 32 of the magazine, the rotor moves counter-clockwise to the position shown in FIG. 7A, allowing the follower 78 to move beneath the last round 92' and cam that round further up the feed ramp 98 and into the feed lips 32. The large radius 130 (FIG. 2) at the forward corner of the follower bridging portion 79 moves under the front of the last round 92' due to the skewed position of the follower in the rotor, thereby feeding the front of the last round up into the feed lips 32 as the rotor moves to the position shown in FIG. 7A. The feed ramp tongue 99 moves into the cutout region 82 of the follower 78, thereby blocking further counter-clockwise movement of the rotor and maintaining the follower 78 in the position of maximum radial extension necessary to support the last round 92' in the feed lips. No further movement of the rotor takes place as the last round 92 is fed from the magazine.

It will thus be seen that the flip-flop mounting of the follower 78 on the rotor allows the follower to be substantially perpendicular to the rotor during last-round feeding, maximizing the effective radius of the rotor at this location. When the drum is fully loaded, however, the follower is pushed over to the position shown in FIG. 7D, reducing the effective radius of the follower-equipped rotor and thereby permitting the previously-mentioned further clockwise rotor movement when the first round 24 is depressed by the closed bolt 127 of the firearm.

Returning to FIGS. 2 and 4, the function of the optional drum spacer 56 should now be more apparent. The longitudinal spacing between the inner surfaces of the drum front wall 13 and lid 14 are chosen to accommodate the longest round for which the drum magazine is designed. When loading and firing these longest rounds, the drum spacer 56 is removed from the drum. When it is desired to load shorter rounds in the drum, the drum is assembled with the drum spacer 56 in place as shown in FIG. 4, so that the peripheral spacer portion 59 of enlarged thickness is positioned in front of the round-receiving recesses **49*a* in the front sprocket 49. The outer edge of the spacer portion 59 is cut away at 60 to avoid interfering with the feed ramp 98 and other structure within the drum. The addition of the drum spacer 56 thus reduces the longitudinal round-receiving distance between the lid 14 and the thickened peripheral portion 59 of the drum spacer. This reduction in longitudinal round-receiving dimension helps maintain shorter rounds in proper position on the rotor sprockets, as illustrated by the typical shorter round 135 shown in phantom outline in FIG. 4, so that the rims of the shorter rounds remain in proper position behind the recesses 50*a* of the back sprocket 50**.

It will be understood that the foregoing is but a preferred embodiment of the present invention, and that numerous changes and modifications may be made therein without departing from the spirit and scope of the invention as defined in the following claims.

I claim:

1. A drum magazine for storing and feeding rounds of ammunition to a firearm, comprising:

a body;

a rotor within said body and biased for rotation;

a plurality of discrete round-receiving recesses defined about the periphery of said rotor to engage and carry a corresponding plurality of rounds along a path within said body;

extension means extending from said body for placement in round feeding relation with a firearm, said extension means having a round-feeding opening and means providing a round feeding path between the extension means and said rotor so that the biased rotation of the rotor serially moves each round-receiving recess to the extension means;

follower means carried by said rotor behind the last round-receiving recess to arrive at the extension means, said follower means operatively assuming a radially extended first position to engage the last round and displace that round outwardly from the rotor recess toward said round-feeding opening when the last round-receiving recess is in round feeding relation to the extension means; and said follower means being movable inwardly to a second position to allow the rotor to be moved past the fully loaded position, thereby providing sufficient room to enable a closed first round of the fully-loaded drum magazine to be displaced in said extension means by the presence of a closed bolt in the firearm when the magazine is placed on the firearm.

2. A drum magazine as in claim 1, further comprising:

feed means cooperating with said rotor means to define said round feeding path between said round-receiving recesses and said extension means;

stationary means located for engagement by said follower means so as to contact the follower means and limit rotation of said rotor means as the last round-feeding recess bears a predetermined relation to said feed mens;

said follower means being movable to said first position to feed the last round along said feed means to said extension means; and said follower means being displacable to said second position in response to contacting said stationary means as said rotor moves against said bias to the fully-loaded position to place the first round-receiving recess at said feed means, so that the follower means in said second position permits limited further rotation of the rotor means past the fully-loaded position;

whereby said further rotation allows the last-loaded round of the fully loaded magazine to be displaced within said extension means by contacting a part of the firearm.

3. The drum magazine as in claim 2, wherein:

said follower means is carried by said rotor means to contact a portion of said feed means at certain angular positions of said rotor in either direction of rotation and prevent further rotation beyond said angular positions, so that said portion of the feed means comprises said stationary means.

4. A drum magazine for storing and feeding rounds of ammunition to a firearm, comprising:

drum body means open at least at one end;

a cover removably closing said open end and having a periphery removably attachable to said open end of said body means;

means associated with said body means and said cover to engage the cover on the body means in response to relative rotation therebetween;

locking means on said cover selectably engaging said body means to prevent said relative rotation, so that said cover cannot rotate to disengage the cover and body means;

said periphery of the cover including a cutout portion to expose a lock engaging region of said body means; and said locking means comprising a first portion movably located on said cover, and further comprising a member extending adjacent said periphery for movement with said first portion and being selectably movable into said cutout portion for engaging said lock engaging region within the cutout portion, thereby preventing the cover from rotating to disengage the body means.

5. A drum cartridge magazine, comprising:

drum body means defining a housing having a front end and a back end, and means closing the front end of said housing;

a back cover removably attachable to the back end of said housing;

a post integral with said front cover means and extending axially inwardly within said cylindrical housing toward said back end of the housing;

axle means retined at the back end of said post and having a member extending beyond the post;

cartridge receiving means disposed within the housing in rotating relation to said post;

said cartridge receiving means having a first axial opening to receive said post and a relatively smaller second opening through which said member extends;

said back cover having an opening through which said member extends;

first locking means removably engaging said member outside said back cover to retain the cover; and second locking means removably engaging said member inside the cover to retain said cartridge receiving means relative to the post.

6. A drum magazine for storing and feeding rounds of ammunition to a firearm, comprising:

drum body means open at lest at one end;

a cover removably closing said open end and having a periphery removably attachable to said open end of said body means;

means associated with said body means and said cover to engage the cover on the body means in response to relative rotation therebetween;

locking means on said cover selectably engaging said body means to prevent said relative rotation, so that said cover cannot rotate to disengage the cover and body means;

said periphery of the cover including a cutout portion to expose a lock engaging region of said body means; and said locking means comprising a member selectably movable into said cutout portion for engaging said lock engaging region, thereby preventing the cover from rotating to disengage the body means.

7. A drum cartridge magazine comprising:

drum body means defining a housing;

axle means disposed within said housing;

a cartridge receiving rotor rotatably located on said axle means;

a torsion spring located on said axle means and having a first end operative to engage said rotor at selectably variable locatoins angularly spaced apart on the rotor, so as to impart selectably variable torque preload to said rotor;

said torsion spring having a second end disposed between rotor and axle means for fixed engagement relative to said body means, so that the first end of the torsion spring can impart torque to the rotor relative to the body means;

said rotor having a first side located adjacent siad first end of the torsion spring, and having a second side axially spaced from said first side;

said first side having a plurality of spring engaging openigns radially spaced from said axle means at said selectably variable locations; and said first end of the torsion spring selectably engaging any of said spring engaging means so as to select the torque applied to the rotor by the torsion spring.

8. A drum cartridge magazine comprising:

drum body means defining a housing;

a post axially disposed within said housing;

a cartridge receiving rotor rotatably located on said post;

a torsion spring located on said post and having a first end operative to engage said rotor at selectably variable locations angularly spaced apart on the rotor, so as to impart selectably variable torque preload to said rotor;

said torsion spring having a second end disposed between rotor and post for fixed engagement relative to said body means, so that the first end of the torsion spring can impart torque to the rotor relative to the body means;

said rotor having a first side located adjacent said first end of the torsion spring, and having a second side axially spaced from said first side;

said first side having a plurality of spring engaging openings radially spaced from said post at said selectably variable locations; and said first end of the torsion spring selectably engaging any of said spring engaging means so as to select the torque applied to the rotor by the torsion spring.

9. The drum magazine as in claim 8, wherein:

said first and second sides of said rotor are axially spaced apart a first distance adjacent said post, so that the coiled length of said torsion spring is substantially disposed on said post between said rotor sides; and said spacing between said rotor sides is reduced at the periphery of said rotor to a spacing less than said first distance and operative to receive and support cartridges received on the rotor.

10. A drum magazine for storing and feeding rounds of ammunition to a firearm, comprising:

a body;

a rotor within said body and biased for rotation;

a plurality of round receiving locations defined about the periphery of said rotor to receive and carry rounds along a path within said body;

extension means extending from said body for placement in round feeding relation with a firearm, said extension means having a round-feeding opening and means providing a round feeding path between the extension means and said rotor so that the biased rotation of the rotor serially moves each round to the extension means;

follower means carried by said rotor behind the last round-receiving location to arrive at the extension means, said follower means operatively assuming a radially extended first position to engage the last round and displace that round outwardly from the rotor toward said round-feeding opening when the last round-receiving location is in round feeding relation to the extension means; said follower means being movable inwardly to a second position to allow the rotor to be moved past the fully loaded position, thereby providing sufficient room to enable a closed first round of the fully-loaded drum magazine to be displaced in said extension means by the presence of a closed bolt in the firearm when the magazine is placed on the firearm;

feed means cooperating with said rotor means to define said round feeding path between said round-receiving locations and said extension means;

stationary means located for engagement by said follower means so as to contact the follower means and limit rotation of said rotor means as the last round-feeding location bears a predetermined relation to said feed means;

said follower means being movable to said first position to feed the last round along said feed means to said extension means;

said follower means being displacable to said second position in response to contacting said stationary means as said rotor moves against said bias to the fully-loaded position to place the first round-receiving location at said feed means, so that the follower means in said second position permits limited further rotation of the rotor means past the fully-loaded position, whereby said further rotation allows the last-loaded round of the fully loaded magazine to be displaced within said extension means by contacting a part of the firearm;

said rotor means comprising a pair of sprockets mounted in mutually spaced apart relation, with recesses formed on the peripheries of said sprockets to provide said round-receiving locations;

said follower means being pivotably mounted on said sprockets behind said last round-receiving location to move between said first and second positions; and said follower means having a follower surface extending between said sprockets to push the last round up said round feeding path and into said extension means as the rotor sprockets moves the last round-receiving recess past said feed means.

11. The drum magazine as in claim 10, wherein said follower surface is skewed relative to the axis of said rotor means so as to initially contact the front of the last round and thereby feed the last round with front end raised.

12. The drum magazine as in claim 11, wherein the front end of said follower surface is rounded to define a radius presenting a cam surface to the last round, thereby enhancing said feeding of the last round.

13. The drum magazine as in claim 10, further comprising:

a slot formed in each sprocket to receive said follower means for said pivotable movement between said first and second positions;

each said slot including a first portion retaining a mating portion of the follower means for pivotable movement of said follower surface between said first and second positions; and each said slot including a second portion cooperating with said follower means to define said first and second positions.

14. The drum magazine as in claim 13, wherein:

said follower means includes a pivot member loosely engaged by said first means of the slot in each sprocket; and said pivot members retaining the follower means against radial separation from the sprockets, yet permitting the follower surface to be withdrawn from the sprockets in a direction substantially parallel to the axis of sprocket rotation.

15. A drum magazine for storing and feeding rounds of ammunition to a firearm, comprising:

a body;

a rotor within said body and biased for rotation;

a plurality of round receiving locations defined about the periphery of said rotor to receive and carry rounds along a path within said body;

extension means extending from said body for placement in round feeding relation with a firearm, said extension means having a round-feeding opening and means providing a round feeding path between the extension means and said rotor so that the biased rotation of the rotor serially moves each round to the extension means;

follower means carried by said rotor behind the last round-receiving location to arrive at the extension means, said follower means operatively assuming a radially extended first position to engage the last round and displace that round outwardly from the rotor toward said round-feeding opening when the last round-receiving location is in round feeding relation to the extension means;

said follower means being movable inwardly to a second position to allow the rotor to be moved past the fully loaded position, thereby providing sufficient room to enable a closed first round of the fully-loaded drum magazine to be displaced in said extension means by the presence of a closed bolt in the firearm when the magazine is placed on the firearm;

feed means cooperating with said rotor means to define said round feeding path between said round-receiving locations and said extension means;

stationary means located for engagement by said follower means so as to contact the follower means and limit rotation of said rotor means as the last round-feeding location bears a predetermined relation to said feed means;

said follower means being movable to said first position to feed the last round along said feed means to said extension means;

said follower means being displacable to said second position in response to contacting said stationary means as said rotor moves against said bias to the fully-loaded position to place the first round-receiving location at said feed means, so that the follower means in said second position permits limited further rotation of the rotor means past the fully-loaded position, whereby said further rotation allows the last-loaded round of the fully loaded magazine to be displaced within said extension means by contacting a part of the firearm;

said follower means being carried by said rotor means to contact a portion of said feed means at certain angular positions of said rotor in either direction of rotation and prevent further rotation beyond said angular positions, so that said portion of the feed means comprises said stationary means;

said feed means comprising a round engaging surface extending to contact rounds carried by said rotor means and to divert said round to said extension means;

said follower means including a follower member which pushes the last round up said round engaging surface toward the extension means; and said follower means further comprising a cutout portion into which said round engaging surface can enter as said follower member pushes the last round up the round engaging surface with the follower means in said first position.

16. The drum magazine as in claim 15, wherein:

said feed means has a front side on which said round engaging surface is disposed, and a back side; and said follower member engages said back side as said rotor means moves to the fully loaded position so as to move the follower means to said second position, wherein the follower member in the second position permits said limited further rotation.

17. A drum magazine for storing and feeding round sof ammunition to a firearm, comprising:

a body;

a rotor within said body and biased for rotation;

a plurality of round receiving locations defined about the periphery of said rotor to receive and carry rounds along a path within said body;

extension means extending from said body for placement in round feeding relation with a firearm, said extension means having a round-feeding opening and means providing a round feeding path between the extension means and said rotor so that the biased rotation of the rotor serially moves each round to the extension means;

follower means removably carried by said rotor behind the last round-receiving location to arrive at the extension means, said follower means operatively assuming a radially extended first position to engage the last round and displace that round outwardly from the rotor toward said round-feeding opening when the last round-receiving location is in round feeding relation to the extension means;

said follower means being movable inwardly to a second position to allow the rotor to be moved past the fully loaded position, thereby providing sufficient room to enable a closed first round of the fully-loaded drum magazine to be displaced in said extension means by the presence of a closed bolt in the firearm when the magazine is placed on the firearm;

feed means cooperating with said rotor means to define said round feeding path between said round-receiving locations and said extension means;

stationary means located for engagement by said follower means so as to contact the follower means and limit rotation of said rotor means as the last round-feeding location bears a predetermined relation to said feed means;

said follower means being displacable to said second position in response to contacting said stationary means as said rotor moves against said bias to the fully-loaded position to place the first round-receiving location at said feed means, so that the follower means in said second position permits limited further rotation of the rotor past the fully-loaded position; whereby said further rotation allows the last-loaded round of the fully loaded magazine to be displaced within said extension means by contacting a part of the firearm;

said rotor mounted for rotation unobstructed by said stationary means, when said follower means is removed; and spring means having a member selectably engaging said rotor at any of a plurality of angularly spaced spring engaging locations so as to selectably vary the rotational torque biasing the rotor, so that the rotor is selectably operable to engage the spring means member at a selected spring engaging location while the rotor initially is in an unbiased position, permitting the rotor to be rotated against the spring means to wind the spring means before said follower means is inserted in the rotor to contact said stationary means and limit rotation caused by the spring means.

18. A drum magazine for storing and feeding rounds of ammunition to a firearm, comprising:

a body including extension means placeable in round feeding relation with a firearm;

a rotor mounted within said body for rotation, and defining a plurality of round receiving locations about the periphery of said rotor to receive and carry rounds along a path within said body;

spring means having a member selectably engaging for and biasing said rotor at any of a plurality of angularly spaced spring engaging locations so as to selectably vary the rotational torque biasing the rotor so that the rotor can engage the spring means member at a selected spring engaging location while the rotor initially is in an unbiased position, permitting the rotor to be rotated against the spring means to wind the spring means, feed means cooperating with said rotor to define a round feeding path between said round-receiving locations and said extension means;

follower means removably carried by said rotor behind the last round-receiving location to arrive at said feed extension means, said follower means operatively assuming a radially extended first position to engage the last round and displace that round outwardly from the rotor toward said round-feeding opening when the last round-receiving location is in round feeding relation to the extension means; and stationary means associated with said body and located for engagement by said follower means when carried by said rotor, so that said follower contacts the stationary means and limits rotation of said rotor as the last round-feeding location bears a predetermined relation to said feed means; and said rotor being rotationally unobstructed by said stationary means when said follower means is removed from the rotor, so that the follower means can be inserted in the rotor to limit rotation in response to the spring means, after the rotor is rotated to wind the spring means.

* * * * *